United States Patent [19]

Radford

[11] Patent Number: 4,753,474

[45] Date of Patent: Jun. 28, 1988

[54] APPARATUS AND SYSTEM FOR CARRYING, STORING AND CONNECTING SCUBA TANKS TOGETHER

[75] Inventor: James T. Radford, Houston, Tex.

[73] Assignee: Tank Tote, Inc., Houston, Tex.

[21] Appl. No.: 38,628

[22] Filed: Apr. 14, 1987

[51] Int. Cl.[4] ..... B65D 63/18

[52] U.S. Cl. ..... 294/160; 294/31.2

[58] Field of Search ..... 294/160, 137, 141, 142, 294/159, 161, 146, 31.2, 23.1, 15, 165, 143, 166, 167, 168, 169; 16/114 R; 215/100 A; 248/313, 316.1

[56] References Cited

U.S. PATENT DOCUMENTS

| | | | |
|---|---|---|---|
| 3,599,828 | 8/1971 | Conway et al. | 294/160 |
| 3,618,997 | 11/1971 | Cochrane | 294/903 |
| 3,817,435 | 6/1974 | De Luca et al. | 294/159 |
| 3,820,696 | 6/1974 | Gongolewski | 294/141 |
| 4,556,245 | 12/1985 | Gruenwald | 294/31.2 |
| 4,560,193 | 12/1985 | Beebe | 294/31.2 |

*Primary Examiner*—James B. Marbert

*Attorney, Agent, or Firm*—Browning, Bushman, Zamecki & Anderson

[57] ABSTRACT

A plastic body having a cylindrical hole through its center has a handle for hand-carrying the body. The hole is at least partially lined with an elastomer. The elastomer lined hole has a diameter approximately $\frac{1}{8}$ to $\frac{1}{4}$ inch larger than the cylindrical tank to be carried. After sliding the plastic body over a cylindrical tank, by tilting the body, the elastomer lined body surrounding the hole makes a two-point contact with the tank to be carried, thus allowing the lifting and carrying of the tank. The body has three T-shaped slots, each one of which is designed to mate with an external fixture for storing the tanks.

13 Claims, 2 Drawing Sheets

APPARATUS AND SYSTEM FOR CARRYING, STORING AND CONNECTING SCUBA TANKS TOGETHER

BACKGROUND OF THE INVENTION

1. Field of the Invention

This invention relates, generally, to apparatus and systems for handling and storing cylindrical tanks, and specifically to the handling and storage of scuba tanks.

2. Description of the Prior Art

Those in the art of making, using or selling scuba tanks (self-contained underwater breathing apparatus) realize that the tank of high pressure air, typically having a pressure in acess of 2250 PSI when full of compressed air, is not only awkward to carry, but can be extremely dangerous if for some reason it is dropped or jarred with too great a force. For example, if left to roll around on the deck of a diving boat, they can roll together, or against a bulkhead and literally explode, causing damage to property and loss of life. Scuba divers have typically used a rubber boot at the lower end of the tank to allow the tank to stand on end, and in addition, have used straps, rope or the like to tie down the tanks in rough water. To the best of the inventor's knowledge, however, those in the art have not heretofore had access to an apparatus which allows an easy hand transportation of the tank, a means for connecting two or more tanks together, and a means for safely storing the tanks when not in use.

SUMMARY OF THE INVENTION

It is therefore the primary object of the present invention to provide a new and improved apparatus for hand carrying a cylindrical tank.

It is another object of the present invention to provide a new and useful system for storing a cylindrical tank.

It is yet another object of the present invention to provide a new and improved system for connecting two or more cylindrical tanks together.

These and other objects, features and advantages of the present invention are accomplished, generally, by the provision of an apparatus having a lightweight, molded plastic body having a bore between two of its opposite sides and having an elastomeric lining in the bore which has a slightly larger diameter than the diameter of the tank to be carried. The body of the apparatus also has one or more T-shaped slots which enable it to be slidably engaged with a fixture mounted on a wall or on the bulkhead of a boat against which the tank is to be stored.

In an alternative embodiment, two or more of the tanks can be connected together through the use of a fixture which slidably engages a slot in each of the apparatus surrounding the tanks to be connected.

BRIEF DESCRIPTION OF THE DRAWINGS

The present invention will be more clearly understood from the following detailed description of specific embodiments, read in conjunction with the accompanying drawings, wherein.

DETAILED DESCRIPTION OF THE PREFERRED EMBODIMENTS

Figure 1:
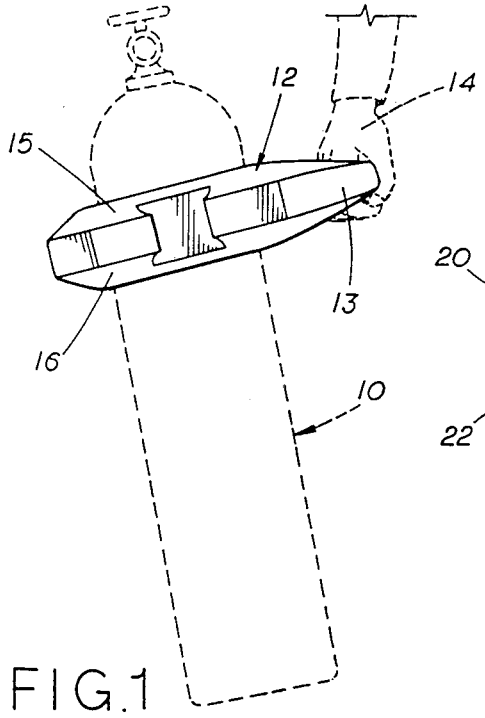
FIG. 1 is a pictorial view, in elevation, of an apparatus according to the present invention in which a conventional scuba tank is located within the interior bore of the apparatus.

Referring now to FIG. 1 of the drawings, a conventional scuba tank 10 is illustrated as being within the center bore 11 (see FIG. 2) of the apparatus 12 having a handle 13 and which is illustrated further as being carried by the human hand 14. Depending upon the extent to which the apparatus 12 slides down the tank 10, the tank 10 will rotate to a greater or lesser degree than that illustrated in FIG. 1 when the tank 10 is being carried.

The apparatus 12 in the preferred embodiment of the present invention is molded from a high impact, low weight plastic having a center bore 11 between its opposite sides 15 and 16 (see FIG. 1). The bore 11 is lined with an elastomeric material 17, for example, rubber. It should be appreciated that the most commonly used scuba tank has an outside diameter of 7.25 inches. Whenever the apparatus 12 is to be used with that particular size of scuba tank, the preferred embodiment of the present invention contemplates the use of a bore 11 having an unlined diameter of 7.50 inches and when lined with the elastomeric material 17, has a diameter of $7\frac{3}{8}$ inches. The distance between the opposite sides 15 and 16 illustrated in FIG. 1, measured along the longitudinal axis of the bore 11, is prferably 3.50 inches of which only 3.25 inches is covered with the elastomeric material 17, best illustrated in FIG. 3.

Other sized scuba tanks can use the apparatus according to the present invention, appropriately sized. For example, when used with a nine inch diameter tank, the elastomeric lined center bore should have a slightly larger diameter, for example $9\frac{1}{8}$ inches. Another scuba tank commonly in use has a diameter of approximately 6.9 inches, sometimes referred to as a 7 inch tank. With that tank, the center bore diameter should be approximately $7\frac{1}{8}$ inches. With the 9 inch tank, it may be an additional advantage to make the elastomeric lined distance between the sides 15 and 16 slightly larger, for example, 3.75 or 4 inches.

On two additional sides 20 and 21, which are on opposite sides of the apparatus 12, there are included the T-shaped slots 22 and 23, respectively. A third T-shaped slot 24 is illustrated on the side 25 opposite the side of the apparatus 12 having the handle 13.

Figure 2:
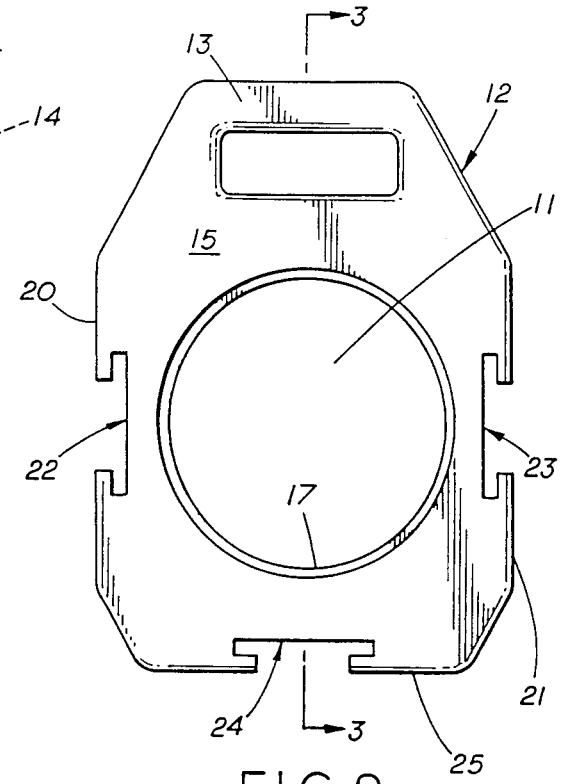
FIG. 2 is a top plan view of the apparatus according to the present invention.
Figure 3:
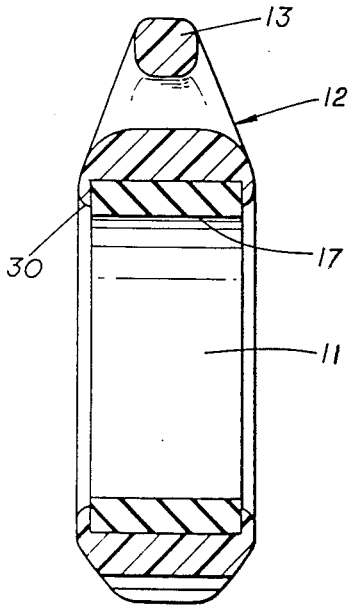
FIG. 3 is an elevational view, partly in cross section, taken along the lines 3—3 of FIG. 2.

Referring now to FIG. 3,there is illustrated, partly in cross section, the apparatus 12 taken along the sectional lines 3—3 of FIG. 2. As can be seen best in FIG. 3, the elastomeric material 17 lines the interior of the bore 11 and protrudes slightly past the lip 30 of the body 12.

In using the apparatus 12 in conjunction with carrying a scuba tank 10 in accordance with the present invention, it should be appreciated that because the bore 11 is only slightly larger in diameter than the diameter of the scuba tank 10, the apparatus 12 can slide over the top of and along the sides of the scuba tank 10 to some convenient location. By lifting the handle 13, the tank 10 will rotate and be cocked at an angle within the interior of the elastomeric lined bore 11. The two-point friction between the elastomer 17 and the exterior of the scuba tank 10 will prevent the tank 10 from sliding out of the apparatus 12, thus allowing the carrying of the tank through the use of the handle 13. Again, the diameter of the elastomeric lined bore 11 should only be slightly larger than the diameter of the tank 10. If the diameter of the bore 11 is too large, the tank 10 will be more likely to slide out of the apparatus 12. If the diameter is too small, it will be more difficult to slide the apparatus 12 over and along the scuba tank 10.

Figure 4:
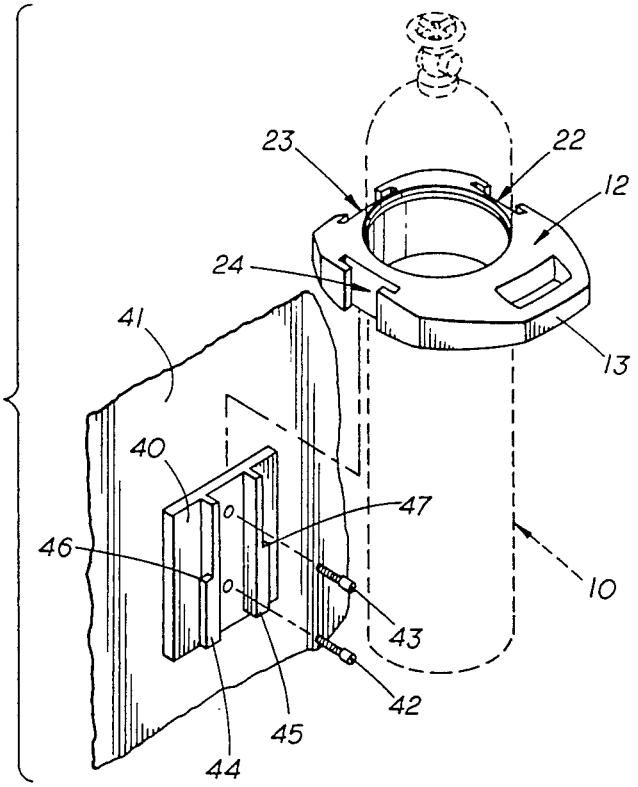
FIG. 4 is a pictorial view of the apparatus in accordance with the present invention, illustrated as encircling a scuba tank, and also showing a wall mounted fixture adapted to slidably engage one of the slots in the apparatus according to the present invention for storing the tank.

FIG. 4 illustrates another utility in accordance with the present invention. As previously explained, the apparatus 12 in its preferred embodimentis shown as having three T-shaped slots 22, 23 and 24. The fixture 40 is shown mounted onto a wall or bulkhead 41 by means of two screws 42 and 43. The fixture 40 has two raised, elongated portions 44 and 45. Each of the raised portions 44 and 45 is L-shaped and dimensioned such that one of the slots 22, 23 or 24 can slide over the top of the raised sections 44 and 45 and come to rest on the shoulders 46 and 47 of the raised portions 44 and 45, respectively.

By providing the fixture 40, which is securedly fastened to the wall or bulkhead 41, and by allowing one of the slots 22, 23 or 24 to slidably engage the raised portions 44 and 45 until settling against the shoulders 46 and 47, the tank 10 can be secured in place against the wall 41. If desired, the tank 10 can have a rubber boot (not illustrated) at its lower end for resting the tank 10 against the floor or deck (not illustrated).

Figure 6:
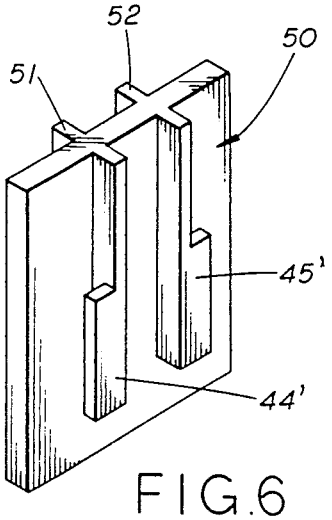
FIG. 6 is a pictorial view of the fixture according to the invention used to connect the tanks together as illustrated in FIG. 5.
Figure 5:
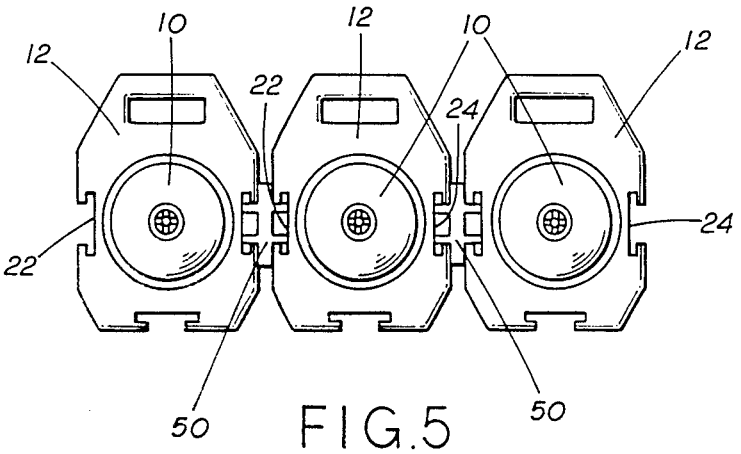
FIG. 5 is a top plan, pictorial view of three cylindrical air tanks connected together in accordance with the present invention.

Referring now to FIG. 5, there is illustrated a system utilizing three of the apparatus 12 which are used to connect three tanks together. This is accomplished through the use of a fixture 50 which amounts to a pair of fixtures 40 mounted back-to-back. Alternatively, fixture 50 can be molded into a single unitary structure having the raised portions 44' and 45' on one side and identical raised portions 51 and 52 on the opposite side as illustrated pictorially in FIG. 6. In addition to connecting the three scuba tanks together in the manner illustrated in FIG. 5, fixture 41 can be used with one of the unused slots, for example slot 24, to mount the three scuba tanks in tandem against a bulkhead or wall as illustrated in FIG. 4.

Those skilled in the art will recognize that the apparatus and systems disclosed and described herein are intended primarily for use with scuba tanks. However, it is intended that such apparatus and systems in accordance with the invention can be used with other cylindrical tanks or bodies. Those skilled in the art will also recognize that cylindrical tanks having diameters other than described herein can utilize the apparatus according to the invention having an elastomer-lined center bore sized slightly larger in diameter than the tank diameter. Moreover, it is not necessary that there be a continuous lining of the bore. Since there is only a two-point contact between the tank and the elastomer lining, the invention contemplates a partial lining, i.e., either a pair of spaced O-rings or a pair of spaced elastomer linings in the bore.

What is claimed is:

1. An apparatus for carrying a cylindrical tank of a given diameter comprising a body having a handle and also having first and second opposing sides, and a bore between said first and second opposing sides of a fixed diameter slightly larger than said given diameter, said bore being lined with an elastomer, said apparatus having no movable parts within said bore.

2. The apparatus according to claim 1 wherein said elastomer lining is of a length taken along the longitudinal axis of the bore, adequate to prevent the tank from sliding out of the bore which the tank is being carried.

3. The apparatus according to claim 2 wherein the length of said lining is approximately 3.25 inches.

4. The appartus according to claim 1 including, in addition thereto, at least one slot in said body, whereby said body can be slottedly attached to a fixture external to said body.

5. The appartus according to claim 4 wherein said at least one slot comprises first, second and third slots, said first and second slots being on third and fourth opposing sides of said body and said third slot and said handle being on fifth and sixth opposing sides of said body.

6. A system for storing against a wall a cylindrical tank of a given diameter, comprising a body having first and second opposing sides, and a bore between said first and second opposing sides of a fixed diameter slightly larger than said given diameter, said system having no movable parts within said bore, said body also having a slot connectable to a fixture external to said body, and a fixture mountable on a wall said fixture being sized to engage said slot.

7. the system according to claim 6 wherein said slot is T-shaped.

8. The system according to claim 6 wherein said bore is lined with an elastomer.

9. A system for connecting together two cylindrical tanks, each of a given diameter, comprising a first body having first and second opposing sides, and a first bore between said first and second opposing sides of a fixed diameter slightly larger than said given diameter, said system having no movable parts within said first bore, a second body having third and fourth opposing sides, and a second bore in said second body between said third and fourth opposing sides of a fixed diameter slightly larger than said given diameter, said system having no movable parts within said second bore, and means for connecting together said first and second bodies.

10. The system according to claim 9 wherein said means for connecting together said first and second bodies comprises:

a first slot in said first body;

a second slot in said second body; and a fixture engageable with said first and second slots.

11. The system according to claim 10 wherein each of said bores is lined with an elastomer.

12. The system according to claim 11 wherein said first and second slots is each T-shaped.

13. An appartus for carrying a cylindrical tank of a given diameter comprising a body having a handle and also having first and second opposing sides, and a bore between said first and second opposing sides of a fixed diameter slightly larger than said given diameter, said bore being at least partially lined with an elastomer, said apparatus having no movable parts within said bore.

* * * * *

UNITED STATES PATENT AND TRADEMARK OFFICE

CERTIFICATE OF CORRECTION

PATENT NO. : 4,753,474

DATED : June 28, 1988

INVENTOR(S) : James T. Radford

It is certified that error appears in the above-identified patent and that said Letters Patent is hereby corrected as shown below:

In column 4, line 17, delete "appartus" and insert therefor --apparatus--;

In column 4, line 21, delete "appartus" and insert therefor --apparatus--;

In column 4, line 33, after "wall" insert a comma --,--; and

In column 4, line 35, delete "the" and insert therefor --The--.

Signed and Sealed this

Tenth Day of January, 1989

*Attest:*

DONALD J. QUIGG

*Attesting Officer*

*Commissioner of Patents and Trademarks*